US008839698B2

(12) United States Patent
Hernández

(10) Patent No.: US 8,839,698 B2
(45) Date of Patent: Sep. 23, 2014

(54) PIVOTABLE AND MAGNETIC WRENCH

(75) Inventor: Melesio Sidón Hernández, Escobedo (MX)

(73) Assignee: International Truck Intellectual Property Company, LLC, Lisle, IL (US)

( * ) Notice: Subject to any disclaimer, the term of this patent is extended or adjusted under 35 U.S.C. 154(b) by 246 days.

(21) Appl. No.: 13/637,666

(22) PCT Filed: Apr. 2, 2010

(86) PCT No.: PCT/US2010/029727
§ 371 (c)(1),
(2), (4) Date: Sep. 27, 2012

(87) PCT Pub. No.: WO2011/123130
PCT Pub. Date: Oct. 6, 2011

(65) Prior Publication Data

US 2013/0008289 A1 Jan. 10, 2013

(51) Int. Cl.
*B25G 1/06* (2006.01)
*B25B 23/16* (2006.01)
*B25B 23/00* (2006.01)

(52) U.S. Cl.
CPC ..... *B25G 1/063* (2013.01); *B25B 23/00* (2013.01)
USPC ..... 81/177.1; 81/180.1

(58) Field of Classification Search
CPC ..... B25G 3/00; B25G 3/38; B25G 1/005; B25G 1/007; B25B 23/00
USPC ..... 81/177.1, 180.1, 462, 489, 491; 269/8, 269/16
See application file for complete search history.

(56) References Cited

U.S. PATENT DOCUMENTS 1,733,642 A * 10/1929 Beduorz ..... 81/478
6,901,823 B2 6/2005 Ernesti

OTHER PUBLICATIONS

Published Application and ISR from parent application.
Search report from parent application.

* cited by examiner

*Primary Examiner* — David B Thomas
(74) *Attorney, Agent, or Firm* — Jeffrey P. Calfa; Mark C. Bach

(57) ABSTRACT

A wrench includes a generally elongate shaft defining an axis and having a first end and a second end opposite the first end. The wrench also includes a handle assembly that is attached to the shaft. The handle assembly terminates in a magnetic mount that is configured to magnetically engage a working surface. The magnetic mount has a passage for receiving the shaft therethrough. The passage is sized and dimensioned to allow the shaft to pivot within the passage and with respect to the magnetic mount.

20 Claims, 3 Drawing Sheets

PIVOTABLE AND MAGNETIC WRENCH

BACKGROUND

Embodiments described herein relate to a wrench, and more particularly, to a wrench having a pivotable and magnetic handle.

In various assembly processes, a wrench is used to provide grip and mechanical advantage to apply torque to a fastener. Depending on the assembly process, the user of the wrench may also be using other tools simultaneously, so that both hands of the user are occupied with tools. For example, in assembly of a vehicle cross member, the user employs one hand to secure an open wrench in place while at the same time, the user employs a second hand to use an impact wrench. With multiple tools being used simultaneously by both hands, one or more of the tools can be dropped by the user.

SUMMARY

A wrench includes a generally elongate shaft defining an axis and having a first end and a second end opposite the first end. The wrench also includes a handle assembly that is attached to the shaft. The handle assembly terminates in a magnetic mount that is configured to magnetically engage a working surface. The magnetic mount has a passage for receiving the shaft therethrough. The passage is sized and dimensioned to allow the shaft to pivot within the passage and with respect to the magnetic mount.

Another wrench includes a generally elongate shaft defining an axis and having a first end and a second end, and a generally U-shaped handle assembly attached to the shaft. The handle assembly includes a first leg terminating in a magnetic mount that is configured to magnetically engage a working surface. The magnetic mount has a passage for receiving the shaft therethrough. The passage is sized and dimensioned to allow the shaft to pivot within the passage and with respect to the magnetic mount. The handle assembly further includes a second leg generally parallel to the first leg and attached to the shaft, and a third leg extending between the first leg and the second leg.

A handle assembly for a wrench having a shaft includes a generally U-shaped support member with a first leg attachable to the shaft, a second leg generally parallel to the first leg and attachable to the shaft, and a third leg extending between the first leg and the second leg. A magnetic mount extends from the first leg and is configured to magnetically engage a working surface at a lower surface of the magnetic mount. The magnetic mount has a passage for receiving the shaft therethrough.

DETAILED DESCRIPTION

Referring to FIGS. 1-5, a pivotable and magnetic wrench is designated generally at 10 and includes a handle assembly 12 attachable to the wrench 10. The wrench 10 can be an open-end wrench, a combination wrench, an adjustable wrench, a socket wrench, or any other type of wrench. For example in the assembly of a vehicle cross member, the wrench 10 may be an open-end wrench, although other wrenches are possible. Further, the handle assembly 12 may be used with any tool having a shaft.

Figure 1:
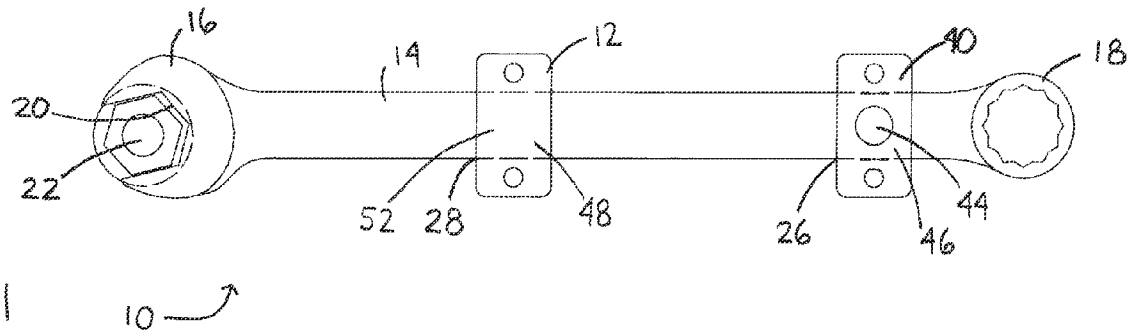
FIG. 1 is a bottom view of a pivotable and magnetic wrench.

The wrench 10 includes a generally elongate shaft 14 with a first end 16 and a second end 18 opposite of the first end. At the first end 16, a generally U-shaped opening 20 is configured to grip two opposing faces of a fastener 22. As seen in FIG. 1, the opening 20 may be oriented about 15-degrees from an axis A defined by the shaft 14, however other angles, or no angle at all, are possible.

Figure 2:
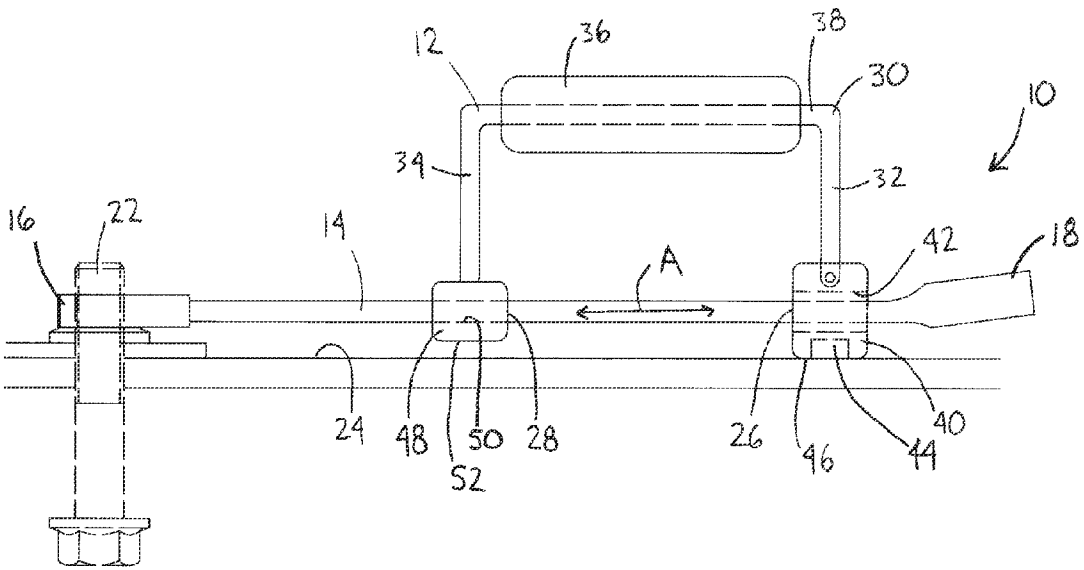
FIG. 2 is a side view of the pivotable and magnetic wrench in a first position generally parallel to a working surface.

In FIG. 2, the wrench 10 may be employed such that the axis of the shaft 14 is generally parallel to a working surface 24, and the fastener 22 is disposed generally perpendicular to the working surface. The working surface 24 may be formed of ferromagnetic materials that attract magnets. While the working surface 24 is shown as generally planar, the wrench 10 may be used with non-planar work surfaces. In the generally parallel position of FIG. 2, the second end 18 of the shaft 14 may be angled with respect to the axis A away from the working surface 24.

The handle assembly 12 is attached to the shaft 14 at a first attachment location 26 and a second attachment location 28. Although any location of attachment along the shaft 14 is possible, there is increased mechanical advantage the further away from the first end 16 that engages the fastener 22 that the handle assembly 12 is located. The handle assembly 12 of the wrench 10 may be located adjacent the second end 18 and extend generally half the length of the shaft 14, however other locations and lengths are possible. Further, it is possible that the handle assembly 12 is cantilevered from the first attachment location 26 without the second attachment location 28, or can have any other shape.

The handle assembly 12 may include a generally U-shaped support member 30 with a first leg 32 attached to the shaft 14 at the first attachment location 26 generally near the second end 18, and a second leg 34 generally parallel with the first leg 32 and attached to the shaft a distance from the first leg 28 at the second location 26, however other shapes of support member are possible. A grip member 36 may be disposed on the support member 26 on a third leg 38 extending between the first leg 32 and the second leg 34. The grip member 36 may be formed of rubber, however other materials are possible. The handle assembly 12 can be removable from the shaft 14, or alternatively, the handle assembly 12 can be fixed to the shaft.

At the first attachment location 26, the handle assembly 12 terminates at a magnetic mount 40 that is attached to and extends from the first leg 32, and is configured to engage the working surface 24. A passage 42 extends through the magnetic mount 40 generally parallel to the axis A for receiving the shaft 14. The cross-sectional dimensions of the passage 42 are larger than the cross-sectional dimensions of the shaft 14 such that the shaft can be moved within the passage to have either a parallel orientation with respect to the passage (see FIG. 2) or an anti-parallel orientation with respect to the passage (see FIGS. 3 and 4). The passage 42 may be generally rectangular-prismatic or cylindrical in shape, however other shapes are contemplated. With the passage 42 sized and dimensioned to allow the shaft 14 to pivot within the passage, the shaft can be oriented at various angles to avoid interferences with component parts or the working surface.

At least one magnet 44 is disposed on the magnetic mount 40 at a lower surface 46 of the magnetic mount, however other locations are possible. The magnet may be generally cylindrical, however other shapes are possible. Further, it is possible that the magnetic mount 40 is itself formed of a magnetic material. The magnetic mount 40 is configured to be attracted to the working surface 24 to selectively fix the wrench 10 with respect to the working surface, while at the same time, allowing the shaft 14 to be oriented at different angles with respect to the working surface.

At the second attachment location 28, a secondary mount 48 is attached to and extends from the second leg 34. A secondary passage 50 extends through the secondary mount 48 for receiving the shaft 14, and the cross-sectional dimensions of the secondary passage 50 are about the same as the shaft 14 such that the shaft has little to no play within the passage, or alternately, the shaft 14 is fixed to the secondary mount 48. When the shaft 14 is generally parallel to the working surface 24, a lower surface 52 of the secondary mount 48 may not contact the working surface 24.

Figure 3:
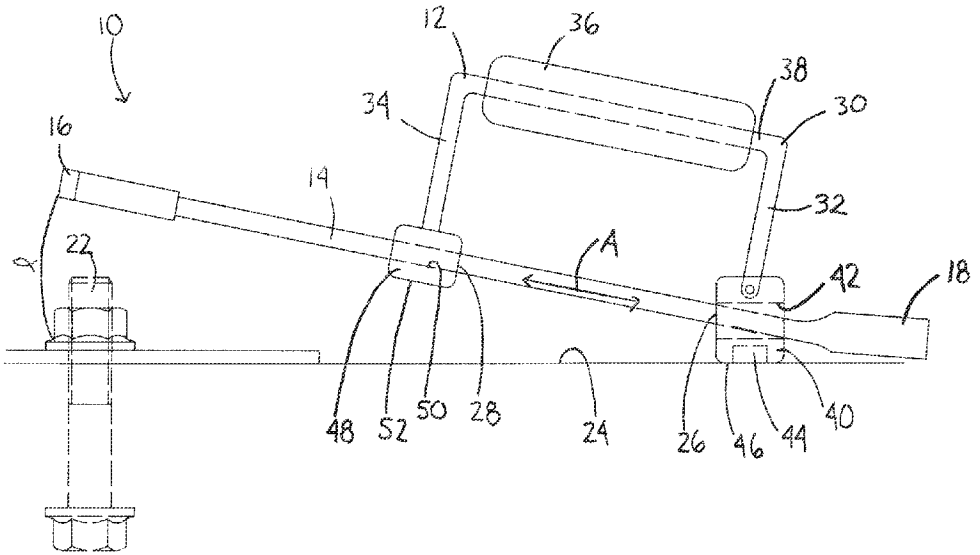
FIG. 3 is a side view of the pivotable and magnetic wrench in a second position generally anti-parallel to the working surface.
Figure 4:
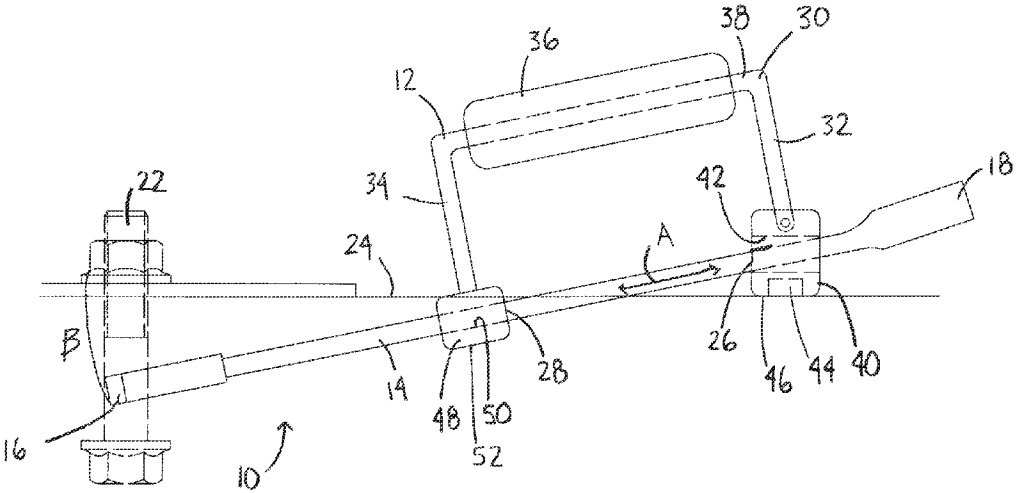
FIG. 4 is a side view of a pivotable and magnetic wrench in a third position generally anti-parallel to the working surface.

Referring now to FIGS. 3 and 4, the shaft 14 is oriented generally anti-parallel to the working surface and generally anti-parallel to the passage 42. The magnetic mount 40 is configured to contact the working surface 24 in the positions of FIGS. 3 and 4. The wrench 10 is selectively fixed to the working surface 24 at the magnetic mount 40, and the first end 16 can be pivoted about the magnetic mount over a range of $\alpha$ plus $\beta$.

Figure 5:
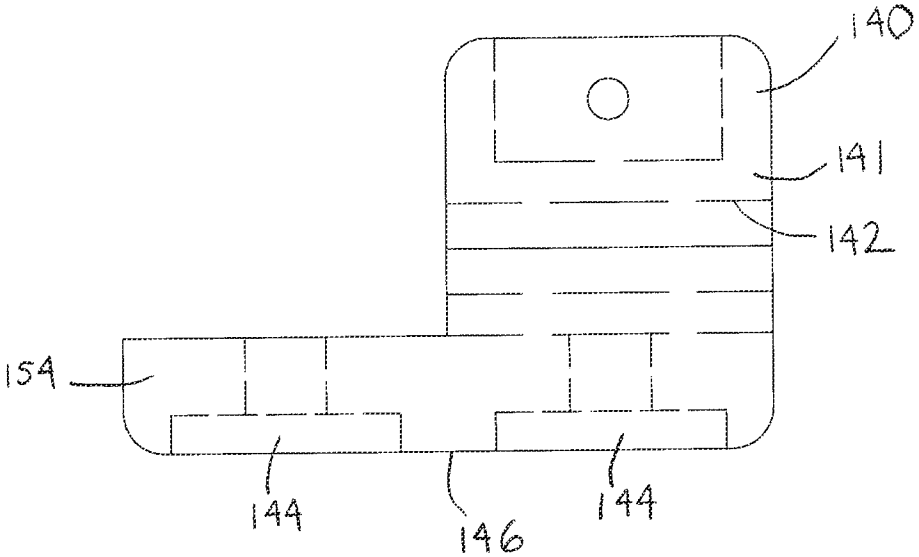
FIG. 5 is a side view of an alternate magnetic mount.

Referring now to FIG. 5, an alternate magnetic mount 140 may be used on the wrench 10. The magnetic mount may have a body portion 141 with a passage 142, and a foot portion 154 extending from the body portion. The foot portion 154 may have a plurality of magnets 144 located at a lower surface 146 of the magnetic mount 140 configured to engage a working surface 24 (FIG. 4). Similar to the magnetic mount 40, the cross-sectional dimensions of the passage 142 are larger than the cross-sectional dimensions of the shaft 14 such that the shaft can be moved within the passage to have either a parallel orientation with respect to the passage (see FIG. 2) or an anti-parallel orientation with respect to the passage (see FIGS. 3 and 4). The passage 142 may be generally rectangular-prismatic or cylindrical in shape, however other shapes are contemplated.

Since the wrench 10 can be selectively attached to any surface that attracts magnets, the user can manipulate multiple tools, including the wrench, without having to hold the wrench or having to put the wrench down. With the wrench 10, assembly processes that typically take two hands can be done with one hand.

What is claimed is:

1. A wrench comprising:

a generally elongate shaft defining an axis and having a first end and a second end opposite the first end; and a handle assembly attached to the shaft, the handle assembly terminating in a magnetic mount that is configured to magnetically engage a working surface, the magnetic mount having a passage for receiving the shaft therethrough, wherein the passage is sized and dimensioned to allow the shaft to pivot within the passage and with respect to the magnetic mount.

2. The wrench of claim 1 wherein the magnetic mount further comprises at least one magnet disposed at a lower surface of the magnetic mount.

3. The wrench of claim 1 wherein the first end of the shaft has a U-shaped opening.

4. The wrench of claim 1 wherein the second end of the shaft is oriented about 10-degrees from the axis and angled towards the handle assembly.

5. The wrench of claim 1 wherein the handle assembly is attached to the shaft at a second attachment location.

6. The wrench of claim 1 wherein the handle assembly has a generally U-shaped support member with a first leg attached to the shaft at a first attachment location generally near the second end of the shaft, and a second leg attached to the shaft a distance from the first leg at a second location.

7. The wrench of claim 6 wherein the handle assembly has a grip member disposed on the support member on a third leg located between the first leg and the second leg.

8. The wrench of claim 6 further comprising a secondary mount attached to and extending from the second leg for attaching the handle assembly to the shaft.

9. The wrench of claim 8 wherein a secondary passage extends through the secondary mount for receiving the shaft.

10. The wrench of claim 8 wherein the magnetic mount further comprises a body portion including the passage extending therethrough, and a foot portion extending from the body portion and configured to engage a working surface.

11. The wrench of claim 1 wherein the passage is one of rectangular-prismatic and cylindrical in shape.

12. A handle assembly for a tool having a shaft, the handle assembly comprising:

a generally U-shaped support member with a first leg attachable to the shaft, a second leg generally parallel to the first leg and attachable to the shaft, and a third leg extending between the first leg and the second leg;

a magnetic mount extends from the first leg and is configured to magnetically engage a working surface at a lower surface of the magnetic mount, the magnetic mount having a passage for receiving the shaft therethrough.

13. The handle assembly of claim 12 wherein the passage is sized and dimensioned to allow the shaft to pivot within the passage and with respect to the magnetic mount.

14. The handle assembly of claim 12 further comprising a secondary mount extending from the second leg and attached to the shaft, wherein the second mount has a secondary passage for receiving the shaft.

15. The handle assembly of claim 12 further comprising a grip member disposed on the third leg.

16. The handle assembly of claim 12 wherein the magnetic mount includes at least one magnet.

17. The handle assembly of claim 16 wherein the at least one magnet is located at the lower surface of the magnetic mount.

18. The handle assembly of claim 12 wherein the magnetic mount further comprises a body portion including the passage, and a foot portion extending from the body portion and configured to engage a working surface.

19. A wrench comprising:

a generally elongate shaft defining an axis and having a first end and a second end opposite the first end; and a generally U-shaped handle assembly attached to the shaft, the handle assembly comprising:

a first leg terminating in a magnetic mount that is configured to magnetically engage a working surface, the magnetic mount having a passage for receiving the shaft therethrough, wherein the passage is sized and dimensioned to allow the shaft to pivot within the passage and with respect to the magnetic mount;

a second leg generally parallel to the first leg and attached to the shaft; and a third leg extending between the first leg and the second leg.

20. The wrench of claim 19 wherein the magnetic mount includes at least one magnet located at a lower surface of the magnetic mount.

* * * * *